US011566313B2

(12) United States Patent
Ota et al.

(10) Patent No.: US 11,566,313 B2
(45) Date of Patent: Jan. 31, 2023

(54) METHOD FOR MANUFACTURING NI-BASED ALLOY MEMBER

(71) Applicant: Mitsubishi Heavy Industries, Ltd., Tokyo (JP)

(72) Inventors: Atsuo Ota, Yokohama (JP); Shinya Imano, Yokohama (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 395 days.

(21) Appl. No.: 16/058,497

(22) Filed: Aug. 8, 2018

(65) Prior Publication Data

US 2019/0048451 A1 Feb. 14, 2019

(30) Foreign Application Priority Data

Aug. 10, 2017 (JP) ..... JP2017-155640
Jul. 19, 2018 (JP) ..... JP2018-135941

(51) Int. Cl.
*C22F 1/10* (2006.01)
*C22C 19/05* (2006.01)
(Continued)

(52) U.S. Cl.
CPC ..... *C22F 1/10* (2013.01); *B22F 3/02* (2013.01); *B22F 3/24* (2013.01); *B22F 9/082* (2013.01);
(Continued)

(58) Field of Classification Search
CPC ..... C22F 1/10
See application file for complete search history.

(56) References Cited

U.S. PATENT DOCUMENTS 4,574,015 A * 3/1986 Genereux ..... C22F 1/10 148/677
5,061,324 A 10/1991 Chang
(Continued)

FOREIGN PATENT DOCUMENTS

CN 101003874 A 7/2007
CN 102653832 A 9/2012
(Continued)

OTHER PUBLICATIONS

Tillack et al. ASM International Handbook Committee. (1991). ASM Handbook, vol. 04—Heat Treating—66.2 Annealing. (pp. 907-912). ASM International. (Year: 1991).*
(Continued)

*Primary Examiner* — Jophy S. Koshy
*Assistant Examiner* — Joshua S Carpenter
(74) *Attorney, Agent, or Firm* — Crowell & Moring LLP

(57) ABSTRACT

Provided is a method for manufacturing an Ni-based alloy member in which the equilibrium amount of γ' phase precipitation at 700° C. is from 30 to 70 volume %. The method includes the steps of preparing an Ni-based alloy powder having a predetermined chemical composition; forming a precursor body wherein an average grain diameter of the γ phase grains is 50 μm or less, by using the Ni-based alloy powder; and heating the precursor body to a temperature at least the γ' phase solvus temperature and subsequently slow-cooling the heated precursor body from the temperature to a temperature at least 100° C. lower than the γ' phase solvus temperature at a cooling rate of 100° C./h or lower. There is obtained a softened body in that the γ' phase particles of at least 20 volume % precipitate between/among the γ phase grains having an average grain diameter of 50 μm or less.

14 Claims, 3 Drawing Sheets

(51) Int. Cl.
*B22F 3/02* (2006.01)
*B22F 3/24* (2006.01)
*B22F 9/08* (2006.01)

(52) U.S. Cl.
CPC ..... *C22C 19/05* (2013.01); *C22C 19/056* (2013.01); *B22F 2003/247* (2013.01); *B22F 2003/248* (2013.01); *B22F 2301/15* (2013.01)

(56) References Cited

U.S. PATENT DOCUMENTS

| | | | | |
|---|---|---|---|---|
| 5,328,659 | A * | 7/1994 | Tillman | C22C 19/056 148/410 |
| 5,649,280 | A | 7/1997 | Blankenship et al. | |
| 5,759,305 | A | 6/1998 | Benz et al. | |
| 6,551,372 | B1 * | 4/2003 | Ewing | C22C 1/0433 419/28 |
| 2010/0303665 | A1 | 12/2010 | Bain et al. | |
| 2015/0368774 | A1 * | 12/2015 | Ota | C22C 19/056 60/752 |
| 2016/0108506 | A1 * | 4/2016 | Sato | C22C 19/05 148/676 |
| 2016/0160334 | A1 | 6/2016 | Imano et al. | |
| 2017/0021424 | A1 | 1/2017 | Tsuno et al. | |
| 2018/0100223 | A1 | 4/2018 | Kobayashi et al. | |
| 2018/0223395 | A1 | 8/2018 | Mourer et al. | |

FOREIGN PATENT DOCUMENTS

| | | | |
|---|---|---|---|
| CN | 105189794 | A | 12/2015 |
| CN | 105200268 | A | 12/2015 |
| CN | 106536781 | A | 3/2017 |
| EP | 0 234 172 | A2 | 9/1987 |
| EP | 2 963 135 | A1 | 1/2016 |
| EP | 3 278 901 | A1 | 2/2018 |
| EP | 3 327 157 | A1 | 5/2018 |
| JP | 58-177445 | A | 10/1983 |
| JP | 9-302450 | A | 11/1997 |
| JP | 2016-3374 | A | 1/2016 |
| JP | 5869624 | B2 | 2/2016 |
| JP | 5985754 | B2 | 9/2016 |
| WO | WO 2016/053489 | A2 | 4/2016 |
| WO | WO 2016/158705 | A1 | 10/2016 |

OTHER PUBLICATIONS

Samal, Prasan K. Newkirk, Joseph W.. (2015). ASM Handbook, vol. 07—Powder Metallurgy (2015)—39.1 General Guidelines. (pp. 395-404). ASM International (Year: 2015).*

William Mankins, Steven Lampman, Heat Treatment of Wrought Nickel Alloys, Heat Treating of Nonferrous Alloys, vol. 4E, ASM Handbook, Edited By George E. Totten, ASM International, 2016, p. 426-458 (Year: 2016).*

Chinese-language Office Action issued in Chinese Application No. 201810898097.0 dated May 27, 2020 with English translation (12 pages).

Extended European Search Report issued in counterpart European Application No. 18187810.9 dated Dec. 13, 2018 (seven (7) pages).

Extended European Search Report issued in European Application No. 19817113.4 dated Feb. 18, 2021 (12 pages).

Huang et al., "The effect of cooling rates from temperatures above the [gamma] solvus on the microstructure of a new nickel-based powder metallurgy superalloy," Journal of Alloys and Compounds, Mar. 7, 2018, pp. 1062-1072, vol. 747, XP055772956 (11 pages).

International Search Report (PCT/ISA/210) issued in PCT Application No. PCT/JP2019/003833 dated Mar. 12, 2019 (three (3) pages).

Chinese-language Office Action issued in Chinese Application No. 201810898097.0 dated Dec. 17, 2020 with partial English translation (seven (7) pages).

Hindi-language Office Action issued in Indian Application No. 201814029543 dated Jan. 5, 2021 with English translation (six (6) pages).

U.S. Restriction Requirement issued in U.S. Appl. No. 16/623,897 dated Aug. 20, 2021 (six (6) pages).

Rao G. A., "Effect of oxygen content of powder on microstructure and mechanical properties of hot isostatically pressed superalloy Inconel 718," Materials Science & Engineering A 435-436, 2006, pp. 84-99 (16 pages).

United States Non-Final Office Action issued in U.S. Appl. No. 16/623,897 dated Oct. 26, 2021 (seven (7) pages).

* cited by examiner

METHOD FOR MANUFACTURING NI-BASED ALLOY MEMBER

CLAIM OF PRIORITY

The present application claims priority from Japanese patent application serial no. 2018-135941 filed on Jul. 19, 2018, which further claims priority from Japanese patent application serial no. 2017-155640 filed on Aug. 10, 2017, the contents of both of which are hereby incorporated by reference into this application.

FIELD OF THE INVENTION

The present invention relates to methods for manufacturing Ni (nickel)-based alloy members and, in particular, to a method for manufacturing an Ni-based alloy member which is excellent in mechanical properties at a high temperature and suitable for a high-temperature member such as a turbine member.

DESCRIPTION OF RELATED ART

In turbines (e.g., gas turbines and steam turbines) for aircrafts and thermal power plants, attaining higher temperature of the main fluid to increase thermal efficiency is now one of technological trends. Thus, improvement of mechanical properties of the turbine members at high temperatures is an important technical issue. High-temperature turbine members (e.g., turbine rotor blades, turbine stator blades, rotor disks, combustor members, and boiler members) are exposed to the severest environments and repeatedly subjected to a rotation centrifugal force and vibration during turbine operation and to thermal stress associated with the start/stop of the operation. Therefore, improvement of mechanical properties (e.g., creep properties, tensile properties, and fatigue properties) is significantly important.

In order to satisfy various mechanical properties required, precipitation-strengthened Ni-based alloy materials have been widely used for high-temperature turbine members. Specifically, in the cases where high-temperature properties are essential, a high precipitation-strengthened Ni-based alloy material is used wherein the percentage of a γ' (gamma prime) phase (e.g., $Ni_3(Al,Ti)$ phase) precipitated in a γ (gamma) phase (matrix) has been increased. An example of such high precipitation-strengthened Ni-based alloy material is an Ni-based alloy material wherein at least 30 volume percent of the γ' phase has been precipitated.

As standard methods for manufacturing turbine members such as turbine rotor blades and turbine stator blades, precise casting techniques (specifically, a unidirectional solidification technique and a single-crystal solidification technique) have been conventionally used in terms of creep properties. On the other hand, a hot forging technique has been occasionally used for manufacturing turbine disks and combustor members in terms of tensile properties and fatigue properties.

However, the precipitation-strengthened Ni-based alloy material has a weak point in that if a volume percentage of the γ' phase is increased so as to increase high-temperature properties of high-temperature members, processability and formability become worse, causing a production yield of the high-temperature members to decrease (i.e., result in increase in production costs). Accordingly, along with the studies to improve properties of high-temperature members, various studies to stably produce the high-temperature members have also been carried out.

For example, JP Hei 9 (1997)-302450 A (corresponding to U.S. Pat. No. 5,759,305) discloses a method of making Ni-based superalloy articles having a controlled grain size from a forging preform. The method includes the following steps of: providing an Ni-based superalloy preform having a recrystallization temperature, a γ'-phase solvus temperature and a microstructure comprising a mixture of γ and γ' phases, wherein the γ' phase occupies at least 30% by volume of the Ni-based superalloy; hot die forging the superalloy preform at a temperature of at least approximately 1600° F., but below the γ'-phase solvus temperature and a strain rate from approximately 0.03 to approximately 10 per second to form a hot die forged superalloy work piece; isothermally forging the hot die forged superalloy workpiece to form the finished article; supersolvus heat treating the finished article to produce a substantially uniform grain microstructure of approximately ASTM 6 to 8; and cooling the article from the supersolvus heat treatment temperature.

According to JP Hei 9 (1997)-302450 A (U.S. Pat. No. 5,759,305), it seems to be possible to produce a forged article at a high production yield without cracking of the forged article even using an Ni-based alloy material in which the γ' phase occupies relatively high volume percent. However, because JP Hei 9 (1997)-302450 A (U.S. Pat. No. 5,759,305) conducts the hot die forging process with superplastic deformation at a low strain rate and the subsequent isothermally forging process, special production equipment as well as long work time is required (i.e., result in high equipment costs and high process costs). These would be the weak points of the technique taught in JP Hei 9 (1997)-302450 A (U.S. Pat. No. 5,759,305).

Since low production costs are strongly required for industrial products, it is one of high-priority issues to establish a technique to manufacture products at low costs.

For example, JP 5869624 B2 discloses a method for manufacturing an Ni-based alloy softened article made up of an Ni-based alloy in which the solvus temperature of the γ' phase is 1050° C. or higher. The method includes a raw material preparation step to prepare an Ni-based alloy raw material to be used for the subsequent softening treatment step, and a softening treatment step to soften the Ni-based alloy raw material in order to increase processability. The softening treatment step is performed in a temperature range which is lower than the solvus temperature of the γ' phase. The softening treatment step includes a first substep to subject the Ni-based alloy raw material to hot forging at a temperature lower than the solvus temperature of the γ' phase, and a second substep to obtain an Ni-based alloy softened material containing 20 volume % or more of incoherent γ' phase particles precipitated on grain boundaries of the γ phase (matrix of the Ni-based alloy) grains, by slowly cooling the above forged material from the temperature lower than the γ' phase solvus temperature at a cooling rate of 100° C./h or less. The technique taught in JP 5869624 B2 seems to be an epoch-making technique that enables the processing and forming of the high precipitation-strengthened Ni-based alloy material at low costs.

However, in the production of a superhigh precipitation-strengthened Ni-based alloy material such as that containing 45 volume percent or more of γ' phase (e.g., Ni-based alloy material in which 45 to 80 volume percent of γ' phase is precipitated), if an ordinary forging facility is used for the hot forging process performed at a temperature lower than the γ' phase solvus temperature (i.e., temperature range in which two phases, γ and γ' phases, coexist), the temperature decreases during the process (causing undesired precipitation of the γ' phase), resulting to be prone to decrease a production yield.

From the viewpoints of recent energy conservation and global environmental protection, higher temperature of the main fluid to increase thermal efficiency of turbines and higher turbine output by increasing the length of the turbine blades are expected to further progress. This means that environments where high-temperature turbine members are used could become more and more sever, and increased mechanical properties of the high-temperature turbine members will be further required. On the other hand, as stated above, achievement of low production costs is one of high-priority issues concerning industrial products.

SUMMARY OF THE INVENTION

In light of such circumstances, it is an objective of the present invention to provide a method for manufacturing an Ni-based alloy member, using high precipitation-strengthened Ni-based alloy material, at a higher production yield than ever before (i.e., lower production costs than ever before).

According to one aspect of the present invention, there is provided a method for manufacturing an Ni-based alloy member having a chemical composition in which the equilibrium amount of precipitation of a γ' phase precipitating in a γ phase of matrix at 700° C. is from 30 volume % to 80 volume %. The manufacturing method comprises: an alloy powder preparation step for preparing an Ni-based alloy powder having the chemical composition; a precursor body formation step for forming a precursor body in which an average grain diameter of the γ phase grains is 50 μm or less, by using the Ni-based alloy powder; and a softening heat treatment step for heating the precursor body to a temperature equal to or higher than the solvus temperature of the γ' phase but lower than the melting temperature of the γ phase in order to dissolve the γ' phase into the γ phase, and subsequently slow-cooling the heated precursor body from the temperature to a temperature at least 50° C. lower than the γ' phase solvus temperature at a cooling rate of 100° C./h or lower, thereby fabricating a softened body in that particles of the γ' phase at least 20 volume % precipitate on grain boundaries of the γ phase grains having an average grain diameter of 50 μm or less.

In the above aspect of a method for manufacturing an Ni-based alloy member, the following modifications and changes can be made.

(i) The chemical composition may be: 5 mass % to 25 mass % of Cr (chromium); more than 0 mass % to 30 mass % of Co (cobalt); 1 mass % to 8 mass % of Al (aluminum); 1 mass % to 10 mass % of Ti (titanium), Nb (niobium) and Ta (tantalum) in total; 10 mass % or less of Fe (iron); 10 mass % or less of Mo (molybdenum); 8 mass % or less of W (tungsten); 0.1 mass % or less of Zr (zirconium); 0.1 mass % or less of B (boron); 0.2 mass % or less of C (carbon); 2 mass % or less of Hf (hafnium); 5 mass % or less of Re (rhenium); 0.003 mass % to 0.05 mass % of O (oxygen); and the balance composed of Ni and unavoidable impurities.

(ii) The Ni-based alloy powder may have an average particle diameter from 5 μm to 250 μm.

(iii) The alloy powder preparation step may include: an atomization substep for forming the Ni-based alloy powder.

(iv) The precursor body formation step may include a hot isostatic press process using the Ni-based alloy powder.

(v) The γ' phase solvus temperature may be 1110° C. or higher.

(vi) The Ni-based alloy member may have a chemical composition in which the equilibrium amount of precipitation of the γ' phase at 700° C. is from 45 volume % to 80 volume %.

(vii) The softened body may have a Vickers hardness of 370 Hv or less at a room temperature.

(viii) The manufacturing method may include additional steps subsequent to the softening heat treatment step: a forming step for forming a shaped workpiece with a desired shape by subjecting the softened body to hot working, warm working, cold working and/or machining; and a solution and aging heat treatment step for subjecting the shaped workpiece to a solution heat treatment so as to decrease the precipitation amount of the γ' phase on the grain boundaries of the γ phase grains to at most 10 volume %, and for subjecting subsequently the shaped workpiece to an aging heat treatment so as to precipitate particles of the γ' phase of at least 30 volume % within the γ phase grains.

Advantages of the Invention

According to the present invention, there can be provided a method for manufacturing an Ni-based alloy member at lower production costs than ever before, using high precipitation-strengthened Ni-based alloy material.

DETAILED DESCRIPTION OF THE PREFERRED EMBODIMENTS

Basic Concept of the Invention

Figure 1A:
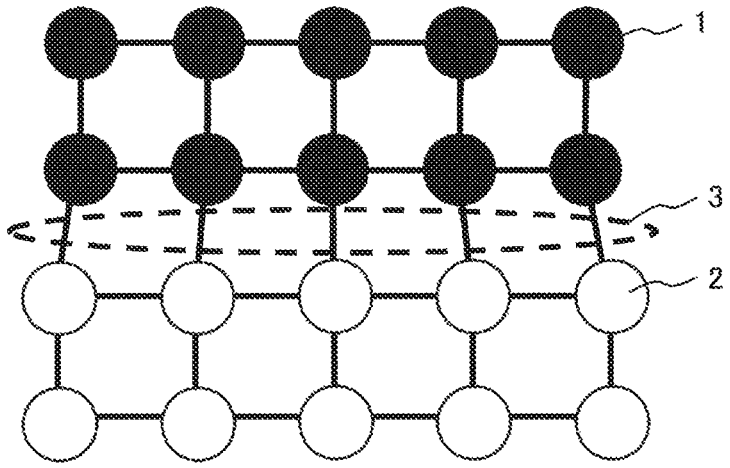
FIGS. 1A and 1B are schematic illustrations showing relationships between a γ phase and a γ' phase contained in a precipitation-strengthened Ni-based alloy material, FIG. 1A a case where the γ' phase particle precipitates within the γ phase grain, and FIG. 1B another case where the γ' phase particle precipitates on a boundary of the γ phase grain.
Figure 1B:
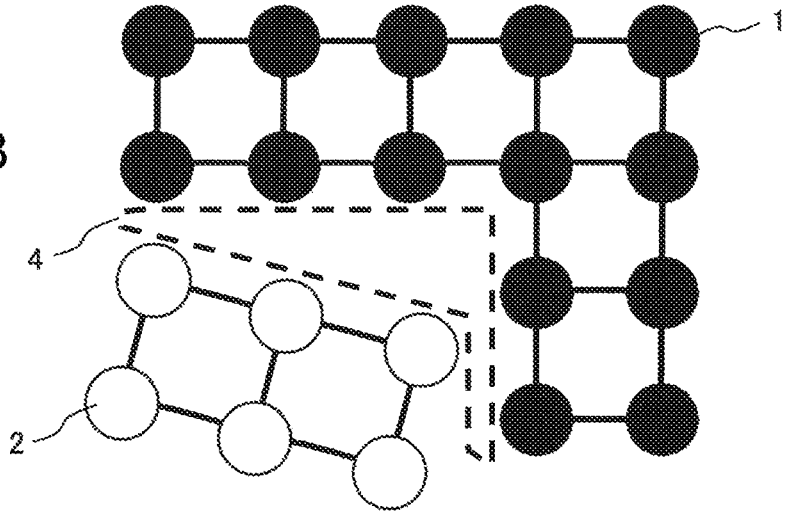

The present invention is based on the precipitation-strengthening/softening mechanism in the γ'-phase precipitating Ni-based alloy material described in JP 5869624 B2. FIG. 1 is schematic illustrations showing relationships between a γ phase and a γ' phase contained in a precipitation-strengthened Ni-based alloy material, (a) a case where the γ' phase particle precipitates within the γ phase grain; and (b) another case where the γ' phase particle precipitates on a boundary of the γ phase grain.

As shown in FIG. 1(*a*), when the γ' phase particle precipitates within the γ phase grain, atoms 1 made up of a γ phase and atoms 2 made up of a γ' phase configure a coherent interface 3 (i.e., the γ' phase particle precipitates while it is lattice-matched to the γ phase grain). This type of γ' phase is referred to as an "intra-granular γ' phase" (also referred to as a "coherent γ' phase"). Because the intra-granular γ' phase particle and the γ phase grain configure a coherent interface 3, it is deemed that dislocation migration within the γ phase grain can be prevented by the intra-granular γ' phase particle.

Accordingly, mechanical strength of the Ni-based alloy material is deemed to increase.

On the other hand, as shown in FIG. 1(*b*), when the γ' phase particle precipitates on a boundary of the γ phase grain (in other words, between/among γ phase grains), the atoms 1 made up of the γ phase and the atoms 2 made up of the γ' phase configure an incoherent interface 4 (i.e., the γ' phase particle precipitates while it is not lattice-matched to the γ phase grain). This type of γ' phase is referred to as a "grain-boundary γ' phase" (also referred to as an "intergranular γ' phase" and an "incoherent γ' phase"). Because the grain-boundary γ' phase particle and the γ phase grain configure an incoherent interface 4, dislocation migration within the γ phase grain is not prevented. As a result, it is deemed that the grain-boundary γ' phase does not contribute to the strengthening of the Ni-based alloy material. Based on the above, in an Ni-based alloy body, by proactively precipitating the grain-boundary γ' phase particle instead of the intra-granular γ' phase particle, it is possible to make the Ni-based alloy body softened, thereby significantly increasing the processability.

Meanwhile, the present invention does not precipitate the grain-boundary γ' phase particle by means of hot forging performed in a temperature range in which two phases, γ and γ' phases, coexist, as described in JP 5869624 B2. The invention is characterized in that it starts with an Ni-based alloy powder and prepares an Ni-based alloy precursor body made up of fine crystal grains (e.g., average crystal grain diameter of 50 μm or less); and the precursor body is then subjected to a predetermined heat treatment in order to form a softened body in which 20 volume % or more of the grain-boundary γ' phase particles are precipitated. The Ni-based alloy precursor body is deemed to be one of the key points of the invention.

Diffusion and rearrangement of atoms configuring a γ' phase are essentially necessary for the generation/precipitation of the γ' phase. Therefore, when the γ phase crystal grains are large as those in the cast material, the γ' phase gains are deemed to preferentially precipitate within the γ phase crystal grains where the distance of diffusion and rearrangement of atoms can be short. Besides, it is not denied that the γ' phase particles precipitate on the boundaries of the γ phase crystal grains even in the cast material.

In contrast, as the γ phase crystal grain becomes finer, a distance to the crystal grain boundary becomes shorter, and the grain boundary free energy becomes higher in comparison with the volume free energy of the crystal grain. Therefore, in terms of the free energy, it is deemed to be more advantageous to diffuse atoms configuring the γ' phase along the gain boundary of the γ phase crystal grain and rearrange those atoms on the grain boundary than performing the solid-phase diffusion and rearrangement of those atoms within the γ phase crystal grain. Thus, those atoms configuring the γ' phase are deemed to preferentially and more easily diffuse and rearrange in such a manner.

Herein, in order to facilitate the formation of the γ' phase particle on the boundary of the γ phase grain, it is important to keep the γ phase grains fine in a temperature range (e.g., in the vicinity of the solvus temperature of the γ' phase) in which at least atoms configuring the γ' phase can easily diffuse. In other words, it is important to suppress the growth of the γ phase grains in the temperature range. Accordingly, the inventors intensively carried out studies of the techniques to suppress the growth of the γ phase grains even in a temperature range equal to or higher than the solvus temperature of the γ' phase.

As a result, by preparing an Ni-based alloy powder containing a predetermined amount of controlled oxygen component and forming an Ni-based alloy precursor body using the Ni-based alloy powder, it is found possible to suppress the growth of the γ phase grains even when the Ni-based alloy precursor body is raised up to a temperature equal to or higher than the γ' phase solvus temperature. Furthermore, by slowly cooling the Ni-based alloy precursor body made up of fine grains from the temperature equal to or higher than the γ' phase solvus temperature, it is found possible to proactively precipitate and grow the incoherent γ' phase particles on the grain boundaries of the γ phase fine grains. The present invention is based on this inventive concept.

Preferred embodiments of the invention will be described hereinafter with reference to the accompanying drawings. However, it should be noted that the invention is not limited to the specific embodiments described below, and various combinations with known art and modifications based on known art are possible without departing from the spirit and scope of the invention where appropriate.

[Method for Manufacturing Ni-Based Alloy Member]

Figure 2:
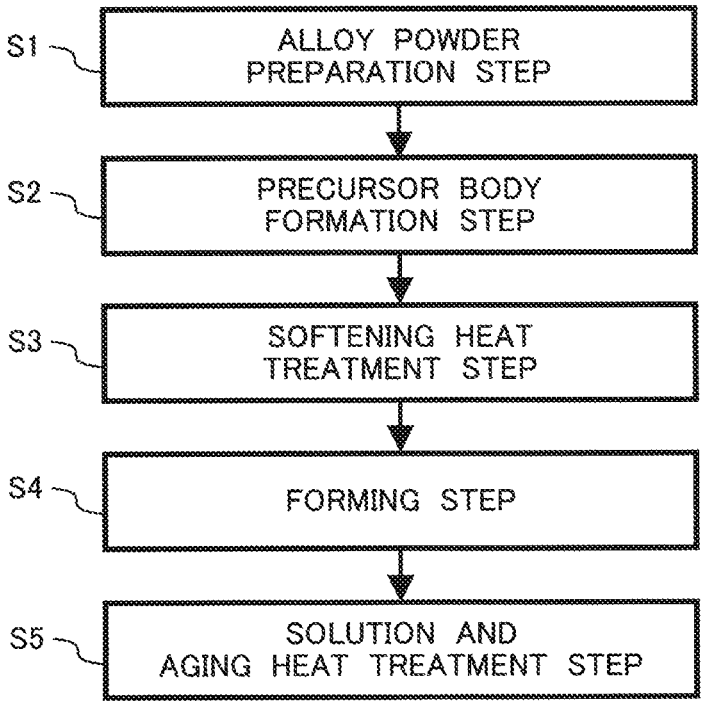
FIG. 2 is an exemplary flow chart showing steps of a method for manufacturing an Ni-based alloy member according to the present invention.

FIG. 2 is an exemplary flow chart showing steps of a method for manufacturing an Ni-based alloy member according to the invention. As shown in FIG. 2, the method for manufacturing an Ni-based alloy member of the invention roughly comprises: an alloy powder preparation step (S1) for preparing an Ni-based alloy powder having a predetermined chemical composition; a precursor body formation step (S2) for forming a precursor body by use of the Ni-based alloy powder; a softening heat treatment step (S3) for fabricating a softened body in which 20 volume % or more of grain-boundary γ' phase precipitates, by subjecting the precursor body to a predetermined heat treatment; a forming step (S4) for forming a shaped workpiece with a desired shape by subjecting the softened body to hot working, warm working, cold working and/or machining; and a solution and aging heat treatment step (S5) for performing a solution heat treatment to dissolve the grain-boundary γ' phase into the γ phase in the shaped workpiece and also performing an aging heat treatment to precipitate particles of the intra-granular γ' phase within the γ phase grains.

Figure 3:
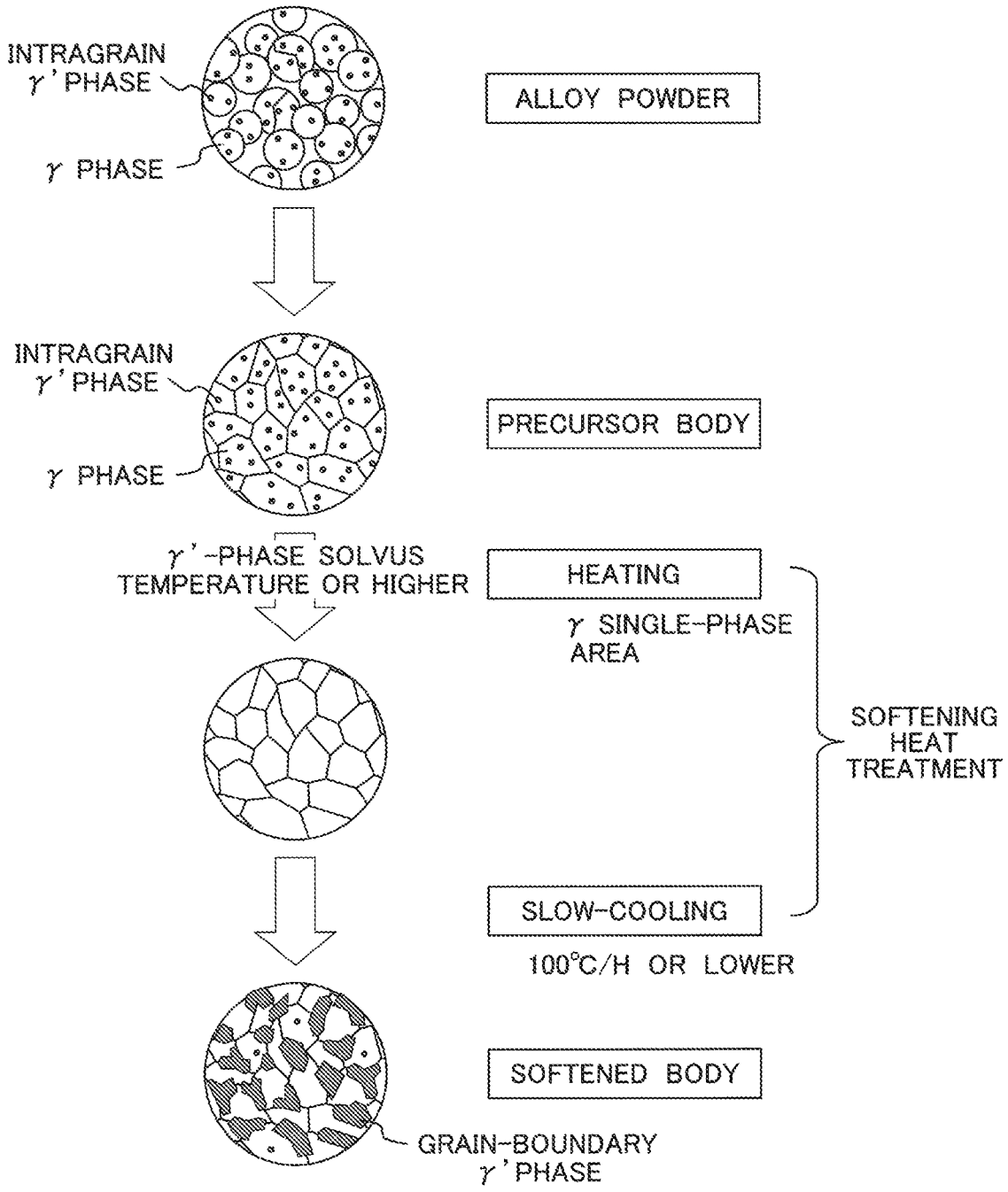
FIG. 3 is a schematic illustration showing an exemplary change of microstructures of an Ni-based alloy material used in a manufacturing method according to the present invention.

FIG. 3 is a schematic illustration showing an exemplary change of microstructures of an Ni-based alloy material used in the manufacturing method according to the invention. First, the Ni-based alloy powder prepared in the alloy powder preparation step is a powder having an average particle diameter of 250 μm or less and essentially made up of the γ phase (matrix) and the γ' phase precipitated within the γ phase. Herein, it could be considered that particles of the Ni-based alloy powder are a mixture of the particles each made up of γ phase single-crystal grain and the particles each made up of γ phase polycrystalline grain.

Next, the precursor body obtained through the precursor body formation step also essentially comprises the γ phase grains (matrix) and the intra-granular γ' phase particles precipitated within the γ phase grains. Herein, depending on the precursor body formation conditions (e.g., formation temperature, cooling rate), a few particles of the grain-boundary γ' phase could also precipitate on the boundaries of the γ phase grains.

Subsequently, the precursor body is heated to a temperature equal to or higher than the solvus temperature of the γ' phase but lower than the melting temperature of the γ phase. When the heating temperature becomes equal to or higher than the γ' phase solvus temperature, the entire γ' phase dissolves in the γ phase to form into a single γ phase in a viewpoint of a thermal equilibrium. Herein, it is important in the invention that the average grain diameter of the γ phase grains keeps 50 μm or less at this stage.

Next, by slowly cooling the precursor body from the heating temperature at a cooling rate of 100° C./h or less, it is possible to obtain a softened body in which 20 volume % or more of grain-boundary γ' phase particles precipitate on the boundaries of the γ phase grains having an average grain diameter of 50 μm or less. The formability of the softened body is significantly excellent because the precipitation-strengthening mechanism does not work due to the sufficiently small amount of precipitation of the intra-granular γ' phase particles.

Although not shown in FIG. 3, the softened body is then processed to form into a shaped workpiece with a desired shape. After that, the shaped workpiece with a desired shape is subjected to the solution heat treatment to dissolve most of the grain-boundary γ' phase into the γ phase (e.g., to decrease the precipitation amount of the grain-boundary γ' phase to at most 10 volume %). Subsequently, the shaped workpiece is subjected to the aging heat treatment to precipitate the intra-granular γ' phase particles of at least 30 volume % within the γ phase grains. As a result, it is possible to obtain a high precipitation-strengthened Ni-based alloy member having a desired shape and sufficiently precipitation-strengthened.

As stated before, the technique described in JP 5869624 B2 requires highly-accurate control in order to fabricate a softened body in which the incoherent γ' phase particles (grain-boundary γ' phase particles, inter-granular γ' phase particles) precipitate while the coherent γ' phase particles (intra-granular γ' phase particles) are intentionally remained. On the contrary, in the manufacturing method of the invention, a softened body is fabricated by first eliminating the intra-granular γ' phase particles and then precipitating the grain-boundary γ' phase particles.

According to the invention, it is possible to obtain the softened body by a combination of not-so-difficult precursor body formation step S2 and not-so-difficult softening heat treatment step S3. Therefore, the method is more versatile than the technique reported in JP 5869624 B2 and can achieve low production costs through the entire production processes. Especially, the invention is effective for the production of a superhigh precipitation-strengthened Ni-based alloy member which contains at least 45 volume % of γ' phase.

Hereinafter, each of the aforementioned steps S1 to S5 will be described in more detail.

(Alloy Powder Preparation Step S1)

In step S1, an Ni-based alloy powder having a predetermined chemical composition (specifically, a predetermined amount of oxygen component intentionally contained) is prepared. Basically, any conventional method or technique can be used to prepare the Ni-based alloy powder. For example, a master alloy ingot fabrication substep (S1*a*) for fabricating a master alloy ingot by mixing, dissolving and casting raw materials to provide a predetermined chemical composition, and an atomization substep (S1*b*) for forming an alloy powder from the master alloy ingot can be performed.

Control of the oxygen content can be preferably performed in the atomization substep S1*b*. Any conventional method or technique can be used for the atomization method except for the control of the oxygen content in the Ni-based alloy. For example, a gas atomization technique and a centrifugal force atomization technique can be preferably used while controlling the oxygen content (oxygen partial pressure) in the atomization atmosphere.

The oxygen component content (also referred to as a "content percentage") in the Ni-based alloy powder is desirably between 0.003 mass % (30 ppm) and 0.05 mass % (500 ppm); more desirably between 0.005 mass % and 0.04 mass %; and further desirably between 0.007 mass % and 0.02 mass %. If the oxygen content is less than 0.003 mass %, the growth of the γ phase grains is not sufficiently suppressed; and if the oxygen content is more than 0.05 mass %, the mechanical strength and ductility of the Ni-based alloy member eventually deteriorate. Meanwhile, it could be considered that oxygen atoms dissolve in the powder particles or form nuclei or embryos of oxides on the surface or the inside of the powder particles.

From the viewpoints of high precipitation-strengthening and efficient formation of the incoherent γ' phase particles, it is preferable that the chemical composition of the Ni-based alloy which enables the γ' phase solvus temperature to become 1000° C. or higher be adopted; more preferably, the γ' phase solvus temperature become 1050° C. or higher; and further more preferably, the γ' phase solvus temperature become 1110° C. or higher. The chemical composition other than the oxygen component will be described in detail later.

The average particle diameter of the Ni-based alloy powder is preferably from 5 μm to 250 μm; more preferably from 10 μm to 150 μm; and further more preferably from 10 μm to 50 μm. If the average particle diameter of the alloy powder becomes less than 5 μm, handling performance in the subsequent step S2 deteriorates and powder particles are prone to coalesce together during the step S2, making it difficult to control the average grain diameter of the γ phase grains of the precursor body. If the average particle diameter of the alloy powder becomes more than 250 μm, it is also difficult to control the average grain diameter of the γ phase grains of the precursor body. The average particle diameter of the Ni-based alloy powder can be measured, for example, by means of a laser diffractometry grain-size distribution measuring apparatus.

Besides, particles of the Ni-based alloy powder are deemed to be a mixture of the particles each made up of γ phase single-crystal grain and the particles each made up of γ phase polycrystalline grain, as mentioned before. Thus, the average γ phase crystal diameter in the particles of the alloy powder is preferably from 5 μm to 50 μm.

(Precursor Body Formation Step S2)

In step S2, a precursor body with an average grain diameter of 50 μm or less is formed using the Ni-based alloy powder prepared in the previous step S1. As long as a dense precursor body can be formed at low costs, a method or technique is not particularly limited and any conventional method or technique can be used. For example, a hot isostatic press technique (HIP technique) can be used preferably. A metal powder additive manufacturing technique (AM technique) can also be used. In terms of low production costs, it is preferable that the superplastic deformation hot forging technique at a low strain rate as described in JP Hei 9 (1997)-302450 A should not be used.

The obtained precursor body is basically made up of the γ phase grains as a matrix and the intra-granular γ' phase particles precipitating inside the γ phase grains as shown in FIG. 3. In addition to the intra-granular γ' phase particles, a small amount of grain-boundary γ' phase particles could precipitate on the grain boundaries of the γ-phase grains. The average grain diameter of the precursor body can be measured by the microstructure observation and the image analysis by means of, e.g., ImageJ as public domain software developed by National Institutes of Health (NIH).

(Softening Heat Treatment Step S3)

In step S3, the Ni-based alloy precursor body prepared in the previous step S2 is heated to a temperature equal to or higher than the γ' phase solvus temperature in order to dissolve the γ' phase particles into the γ phase grains, and then slowly cooled from that temperature to generate and increase the grain-boundary γ' phase particles, thereby fabricating a softened body. In order to suppress undesired coarsening of the γ phase grains as much as possible during this process, slow-cooling start temperature is preferably lower than the γ phase solidus temperature; more preferably at most 25° C. higher than the γ' phase solvus temperature; and further preferably at most 20° C. higher than the γ' phase solvus temperature.

Meanwhile, if the γ phase solidus temperature is lower than the "γ' phase solvus temperature+25° C." or "γ' phase solvus temperature+20° C.", it is obvious that "less than the γ phase solidus temperature" takes priority.

Also, in the step S3, it is not denied that the intra-granular γ' phase does not disappear completely and it slightly remains. For example, if the residual amount of intra-granular γ' phase is 5 volume % or less, it is allowable because the formability in the subsequent forming step will not be inhibited significantly. The residual amount of intra-granular γ' phase is preferably 3 volume % or less; and more preferably 1 volume % or less.

Herein, according to the technique described in JP 5869624 B2, when the Ni-based alloy forged raw material obtained through the dissolving, casting and forging processes is heated to a temperature equal to or higher than the γ' phase solvus temperature, the γ' phase particles suppressing the migration of grain boundaries of the γ phase grains disappear, causing the γ phase grains to become coarsened rapidly. As a result, even if slow-cooling is performed after the heating process as done in the step S3 of the present invention, precipitation and growth of the grain-boundary γ' phase particles hardly progress.

In contrast, according to the invention, the Ni-based alloy powder prepared in the alloy powder preparation step S1 contains more oxygen in the alloy composition than that in the conventional Ni-based alloys. In other words, the Ni-based alloy powder is controlled so as to contain a large amount of oxygen components. As for the precursor body formed using such an alloy powder, it could be considered that the contained oxygen atoms chemically-combine with metal atoms of the alloy to form an oxide locally during the formation of the precursor body.

The thus formed oxide is deemed to suppress migration of the grain boundaries of the γ phase grains (i.e., suppress growth of the γ phase grains). This means that even if the γ' phase is eliminated in the step S3, it is considered possible to prevent coarsening of the γ phase grains.

As the cooling rate in the slow-cooling process becomes lower, it is more advantageous for the precipitation and growth of the grain-boundary γ' phase particles. The cooling rate is preferably 100° C./h or less; more preferably 50° C./h or less; and further preferably 10° C./h or less. If the cooling rate is higher than 100° C./h, the intra-granular γ' phase particles preferentially precipitate, and the functional effect of the invention cannot be acquired.

In the case that the γ' phase solvus temperature is relatively low of 1000° C. or more and 1110° C. or less, end temperature of the slow-cooling is preferably at least 50° C. lower than the γ' phase solvus temperature; more preferably at least 100° C. lower than the γ' phase solvus temperature; and further preferably at least 150° C. lower than the γ' phase solvus temperature. In the case that the γ' phase solvus temperature is relatively high of more than 1110° C., end temperature of the slow-cooling is preferably at least 100° C. lower than the γ' phase solvus temperature; more preferably at least 150° C. lower than the γ' phase solvus temperature; and further preferably at least 200° C. lower than the γ' phase solvus temperature. More specifically, it is preferable that slow-cooling be performed down to a temperature between 1000° C. and 800° C., inclusive. The cooling from the slow-cooling end temperature is preferably performed at a high cooling rate in order to suppress the precipitation of the intra-granular γ' phase particles (e.g., the precipitation amount of the intra-granular γ' phase of at most 5 volume %) during the cooling process. For example, water-cooling or gas-cooling is preferable.

As mentioned before, the strengthening mechanism of the precipitation-strengthened Ni-based alloy material is the result of the formation of a coherent interface between the γ phase and the γ' phase, and an incoherent interface does not contribute to the strengthening. In other words, it is possible to obtain a softened body having an excellent formability and processability by reducing the amount of intra-granular γ' phase (coherent γ' phase) and increasing the amount of grain-boundary γ' phase (inter-granular γ' phase, incoherent γ' phase).

More specifically, to ensure excellent formability and processability, it is preferable that the residual amount of intra-granular γ' phase be 5 volume % or less, and the amount of precipitation of the grain-boundary γ' phase be 20 volume % or more. More preferably, the amount of precipitation of the grain-boundary γ' phase should be 30 volume % or more. The amount of precipitation of the γ' phase can be measured by the microstructure observation and the image analysis (e.g., using ImageJ).

As an index of formability and processability, it is possible to adopt a Vickers hardness (Hv) of the softened body at a room temperature. As for the Ni-based alloy softened body obtained through the step S3, it is possible to obtain an Ni-based alloy softened body having the room-temperature Vickers hardness of 370 Hv or less even by using a super-high precipitation-strengthened Ni-based alloy material in which the equilibrium amount of precipitation of the γ' phase at 700° C. is 50 volume % or more. It is more preferable for better formability and processability that the room-temperature Vickers hardness be 350 Hv or less; and further more preferably be 330 Hv or less.

(Forming Step S4)

In step S4, the Ni-based alloy softened body prepared in the previous step S3 is formed into a shaped workpiece with a desired shape. A forming method is not particularly limited and any conventional low-cost plastic working (e.g., hot, warm, or cold plastic working) and machining (e.g., cutting) can be used. A solid-phase welding such as friction stir welding can also be used.

In other words, the softened body prepared in the step S3 has the room-temperature Vickers hardness of 370 Hv or less. Therefore, it is not necessary to use a high-cost processing method such as superplastic working using an isothermal forging facility for forming. Easiness of forming in the step S4 will achieve the reduction of equipment cost and process cost and the increase in a production yield (i.e., reduction of Ni-based alloy member production costs).

(Solution and Aging Heat Treatment Step S5)

In step S5, the Ni-based alloy shaped workpiece prepared in the previous step S4 is subjected to a solution heat treatment to dissolve the grain-boundary γ' phase into the γ phase and also to an aging heat treatment to re-precipitate the intra-granular γ' phase particles within the γ phase grains. Conditions of the solution heat treatment and aging heat treatment are not particularly limited, and any conditions suitable for an environment where the Ni-based alloy member is used can be applied.

Meanwhile, in the step S5, it is not denied that the grain-boundary γ' phase does not disappear completely and it slightly remains. For example, if it can be secured the precipitation amount of intra-granular γ' phase (e.g., at least 30 volume %) for satisfying the mechanical strength required for the Ni-based alloy member, the residual amount of grain-boundary γ' phase precipitation of at most 10 volume % would be allowable. In other words, the step S5 comprises: a solution heat treatment so as to decrease the precipitation amount of the grain-boundary γ' phase to at most 10 volume %; and an aging heat treatment so as to precipitate the intra-granular γ' phase of at least 30 volume %. In addition, a small amount of the residual grain-boundary γ' phase could provide with an incidental functional effect improving the ductility and toughness in a high precipitation-strengthened Ni-based alloy member of the invention.

By performing this step S5, it is possible to obtain a high precipitation-strengthened Ni-based alloy member having desired mechanical properties. The obtained Ni-based alloy member can be preferably used for next-generation high-temperature turbine members (e.g., turbine rotor blades, turbine stator blades, rotor disks, combustor members, and boiler members).

(Chemical Composition of Ni-Based Alloy Member)

Chemical composition of the Ni-based alloy material used in the invention will be described. The Ni-based alloy material has a chemical composition that allows the equilibrium amount of precipitation of the γ' phase of from 30 volume % or more and 80 volume % or less at 700° C. Specifically, a preferable chemical composition (in mass percent) is as follows: 5% to 25% of Cr; more than 0% to 30% of Co; 1% to 8% of Al; total amount of Ti, Nb and Ta of between 1% and 10%, inclusive; 10% or less of Fe; 10% or less of Mo; 8% or less of W; 0.1% or less of Zr; 0.1% or less of B; 0.2% or less of C; 2% or less of Hf; 5% or less of Re; 0.003% to 0.05% of O; and other substances (Ni and unavoidable impurities). Hereinafter, each component will be described.

The Cr component dissolves in the γ phase and also forms an oxide (e.g., $Cr_2O_3$) coating on the surface of the Ni-based alloy member in an actual use environment, thereby increasing corrosion resistance and oxidation resistance. To apply this functional effect onto high-temperature turbine members, it is essential to add at least 5 mass % of Cr. However, excessive adding of the Cr accelerates the formation of a harmful phase. Therefore, the Cr content is preferably 25 mass % or less.

The Co component, which is an element similar to Ni, dissolves in the γ phase in substitution for Ni. The Co component can increase corrosion resistance as well as increasing creep strength. It can also decrease the γ' phase solvus temperature, thereby increasing the high-temperature ductility. However, excessive adding of the Co accelerates the formation of a harmful phase. Therefore, the Co content is preferably more than 0 mass % to 30 mass %.

The Al component is an indispensable component for forming a γ' phase that is a precipitation-strengthening phase for an Ni-based alloy. The Al component can also contribute to increase in oxidation resistance and corrosion resistance by forming an oxide (e.g., $Al_2O_3$) coating on the surface of the Ni-based alloy member in an actual use environment. The Al content is preferably from 1 mass % to 8 mass % according to a desired amount of γ' phase precipitation.

In the same manner as the Al component, the Ti component, the Nb component and the Ta component can also form the γ' phase and increase high-temperature strength. The Ti and Nb components can also increase corrosion resistance. However, excessive adding of those components accelerates the formation of a harmful phase. Therefore, the total amount of Ti, Nb and Ta components is preferably between 1 mass % and 10 mass %, inclusive.

When the Fe component substitutes the Co component or the Ni component, it is possible to reduce alloy material costs. However, excessive adding of the Fe accelerates the formation of a harmful phase. Therefore, the Fe content is preferably 10 mass % or less.

The Mo component and the W component dissolve in the γ phase and can increase high-temperature strength (so-called solid solution strengthening). Therefore, it is preferable that either one component be added. The Mo component can also increase corrosion resistance. However, excessive adding of those components accelerates the formation of a harmful phase or deteriorates ductility and high-temperature strength. Therefore, the Mo content is preferably 10 mass % or less, and the W content is preferably 8 mass % or less.

The Zr component, the B component and the C component can strengthen the gain boundaries of the γ phase grains (i.e., strengthening of tensile strength along the direction perpendicular to the grain boundary of the γ phase grain), thereby increasing high-temperature ductility and creep strength. However, excessive adding of those components deteriorates formability and processability. Therefore, the Zr content is preferably 0.1 mass % or less, the B content is preferably 0.1 mass % or less, and the C content is preferably 0.2 mass % or less.

The Hf component can increase oxidation resistance. However, excessive adding of the Hf accelerates the formation of a harmful phase. Therefore, the Hf content is preferably 2 mass % or less.

The Re component can contribute to the solid solution strengthening of the γ phase and increase corrosion resistance. However, excessive adding of the Re accelerates the formation of a harmful phase. Furthermore, since the Re is an expensive element, increase of the additive amount will result in increase of alloy material costs. To avoid this disadvantage, the Re content is preferably 5 mass % or less.

The O component is usually treated as an impurity and an attempt is often made to reduce the O component. However, in the invention, as stated before, the O component is an indispensable component to suppress the growth of the γ phase grains and facilitate the formation of the incoherent γ' phase particles. The content of the O component is preferably between 0.003 mass % and 0.05 mass %.

The balance of the Ni-based alloy material is the Ni component and unavoidable impurities other than the O component. For example, unavoidable impurities are N (nitrogen), P (phosphorus), and S (sulfur).

EXAMPLES

Hereinafter, the present invention will be described in more detail with reference to a variety of experiments. However, the invention is not limited to those experiments.

Experimental 1

(Fabrication of Ni-Based Alloy Precursor Bodies According to Examples 1 to 8 and Comparative Examples 1 to 6)

First, a master ingot (10 kg) was prepared by mixing, melting and casting raw materials according to the chemical composition indicated in Examples 1 to 8 and Comparative examples 1 to 6 shown in Table 1. Melting was performed by means of a vacuum induction melting technique. Next, the obtained master ingot was re-molten and an Ni-based alloy powder was prepared by means of a gas atomization technique while the oxygen partial pressure in the atomization atmosphere was controlled.

The obtained Ni-based alloy powder was classified and an alloy powder having particle diameters from 10 to 50 μm was selected. The alloy powder was then used to prepare an HIP formed body by means of a hot isostatic press technique (HIP technique). The HIP conditions were stress of 100 MPa, temperature of 1160 to 1200° C., and duration of 3 hours. Subsequently, the obtained HIP formed body was subjected to electrical-discharge machining, thereby preparing a columnar (15-mm diameter) Ni-based alloy precursor body.

TABLE 1

Chemical compositions of Ni-based alloy precursor bodies of Examples 1 to 8 and Comparative examples 1 to 8.

| | Chemical composition (mass %) | | | | | | | | | | | | | | | |
|---|---|---|---|---|---|---|---|---|---|---|---|---|---|---|---|---|
| | Cr | Co | Al | Ti | Nb | Ta | Fe | Mo | W | Zr | B | C | Hf | Re | O | Ni |
| Example 1 | 14.9 | 18.5 | 3.0 | 3.6 | 1.1 | 2.0 | — | 5.0 | — | 0.06 | 0.015 | 0.027 | 0.5 | — | 0.012 | Bal. |
| Example 2 | 13.8 | 6.8 | 4.0 | 5.2 | 1.2 | 2.8 | — | 1.8 | 4.0 | — | 0.015 | 0.015 | — | — | 0.037 | Bal. |
| Example 3 | 16.0 | 14.6 | 2.7 | 4.9 | — | — | 0.2 | 2.8 | 1.2 | — | — | 0.015 | — | 1.5 | 0.011 | Bal. |
| Example 4 | 6.0 | 18.2 | 3.6 | 3.4 | 1.4 | 2.7 | — | 3.8 | 1.9 | 0.05 | 0.030 | 0.030 | — | — | 0.029 | Bal. |
| Example 5 | 15.7 | 8.4 | 2.3 | 3.4 | 1.1 | — | 4.0 | 3.1 | 2.7 | — | 0.012 | — | — | — | 0.011 | Bal. |
| Example 6 | 13.4 | 10.2 | 3.9 | 2.5 | — | 4.7 | — | 1.7 | 4.5 | 0.03 | 0.017 | 0.090 | — | — | 0.008 | Bal. |
| Example 7 | 14.9 | 17.0 | 4.0 | 3.6 | — | — | — | 5.2 | — | — | 0.040 | 0.050 | — | 1.5 | 0.011 | Bal. |
| Example 8 | 18.9 | 19.0 | 1.9 | 3.7 | 1.0 | 1.4 | — | — | 5.9 | 0.03 | 0.005 | 0.15 | — | — | 0.013 | Bal. |
| Comparative example 1 | 13.5 | 23.5 | 2.4 | 6.2 | — | — | — | 2.9 | 1.2 | 0.05 | 0.026 | 0.016 | — | — | 0.014 | Bal. |
| Comparative example 2 | 13.9 | 7.9 | 3.5 | 2.5 | 3.4 | — | — | 3.3 | 3.5 | 0.05 | 0.010 | 0.14 | — | — | 0.013 | Bal. |
| Comparative example 3 | 15.7 | 8.4 | 2.3 | 3.4 | 1.1 | — | 4.0 | 3.1 | 2.7 | — | 0.011 | — | — | — | 0.013 | Bal. |
| Comparative example 4 | 16.0 | 13.2 | 2.2 | 3.6 | 0.8 | — | — | 3.9 | 4.1 | 0.03 | 0.017 | 0.028 | — | — | 0.016 | Bal. |
| Comparative example 5 | 19.6 | 13.5 | 1.3 | 3.0 | — | — | — | 4.2 | — | — | 0.005 | 0.075 | — | — | 0.007 | Bal. |
| Comparative example 6 | 20.2 | — | 1.2 | 1.6 | — | — | — | 10.4 | — | — | 0.004 | 0.030 | — | — | 0.007 | Bal. |
| Comparative example 7 | 15.8 | 14.8 | 2.5 | 5.1 | — | — | 0.13 | 2.9 | 1.1 | — | — | 0.017 | — | — | 0.002 | Bal. |
| Comparative example 8 | 13.4 | 24.1 | 2.3 | 6.2 | — | — | — | 3.1 | 1.2 | 0.05 | 0.028 | 0.015 | — | — | 0.001 | Bal. |

—: This symbol indicates that the component was intentionally excluded.

Bal.: This symbol means that unavoidable impurities other than the O component are included.

Experimental 2

(Fabrication of Ni-Based Alloy Precursor Bodies According to Comparative Examples 7 and 8)

In the same manner as Experimental 1, a master ingot (10 kg) was prepared by mixing, melting and casting raw materials according to the chemical composition indicated in Comparative examples 7 and 8 shown in Table 1. Then, the obtained master ingots were subjected to a homogenization heat treatment, and then to hot forging (1100 to 1200° C.), thereby preparing a columnar (15-mm diameter) forged body. Subsequently, the obtained forged bodies were again subjected to a homogenization heat treatment (temperature of 1170 to 1200° C. and duration of 20 hours), thereby preparing the Ni-based alloy precursor bodies of Comparative examples 7 and 8.

Experimental 3

(Quantitative Analysis of Oxygen Content in Ni-Based Alloy Precursor Bodies)

Portions were sampled from the Ni-based alloy precursor bodies prepared in Experimentals 1 and 2, and quantitative analysis of the oxygen content was performed. As a result, as shown in Table 1, it is confirmed that the oxygen content in each of the Ni-based alloy precursor bodies according to Examples 1 to 8 and Comparative examples 1 to 6 is at least 0.003 mass %, and the oxygen content in each of the Ni-based alloy precursor bodies according to Comparative examples 7 and 8 is less than 0.003 mass %.

Experimental 4

(Fabrication of Ni-Based Alloy Softened Bodies According to Examples 1 to 8 and Comparative Examples 1 to 8)

The Ni-based alloy precursor bodies obtained in Experimentals 1 and 2 were subjected to a softening heat treatment under the heat treatment conditions (i.e., slow-cooling start temperature, and cooling rate during the slow-cooling process) indicated in Table 2, described later, thereby fabricating the Ni-based alloy softened bodies according to Examples 1 to 8 and Comparative examples 1 to 8. The slow-cooling end temperature was set to 950° C. except for Comparative examples 3 to 6, and set to 800° C. for Comparative examples 3 to 6.

Experimental 5

(Evaluation of Ni-Based Alloy Softened Bodies According to Examples 1 to 8 and Comparative Examples 1 to 8)

As for the Ni-based alloy softened bodies obtained in Experimental 4, observation of the microstructure (average grain diameter of the γ phase and precipitation amount of the grain-boundary γ' phase), measurement of the room-temperature Vickers hardness, and evaluation of formability and processability (hot working properties, cold working properties) were performed. Data and evaluation results of the Ni-based alloy softened bodies are shown in Table 2.

In Table 2, the equilibrium amount of precipitation of the γ' phase at 700° C. and the γ' phase solvus temperature were obtained by the thermodynamic calculation based on the alloy composition. The average grain diameter of the γ phase and the amount of precipitation of the grain-boundary γ' phase were obtained by the microstructure observation of the softened bodies by means of an electron microscope and the image analysis (ImageJ). The room-temperature Vickers hardness of the softened bodies was measured by a micro-Vickers hardness meter.

The hot working properties were evaluated by visually checking for cracks after the softened body had been heated and the diameter thereof has been reduced to 15 mm by a hot forging technique using a swaging machine. The article free of a crack is judged to be "Passed" and the article with a crack is judged to be "Failed".

The cold working properties were evaluated by visually checking for fractures after the softened body had been drawn using a drawing machine at a room temperature so that the diameter thereof becomes 5 mm. The article free of a fracture is judged to be "Passed" and the article with a fracture is judged to be "Failed".

Therefore, it is confirmed that sufficient formability and processability cannot be ensured.

In the softened bodies according to Comparative examples 3 and 4 in which the slow-cooling start temperature for the softening heat treatment is outside of the invention, as the slow-cooling start temperature becomes lower than the γ' phase solvus temperature, the precipitation amount of the grain-boundary γ' phase decreases (instead, increase in the precipitation of the intra-granular γ' phase was detected), and the room-temperature Vickers hardness is more than 370 Hv. As a result, both the hot working properties and the cold working properties are failed. When a top temperature during the softening heat treatment (i.e., slow-cooling start temperature) is too low, the grain-boundary γ' phase rarely precipitates and grows. Therefore, it is confirmed that sufficient formability and processability cannot be ensured.

In the softened bodies according to Comparative examples 5 and 6 in which the equilibrium amount of precipitation of the γ' phase at 700° C. is outside of the invention, the equilibrium amount of the γ' phase precipitation is less than 30 volume %. Those softened bodies are not applicable to the high precipitation-strengthened Ni-based alloy materials prescribed by the invention. However, the precipitation amount of the γ' phase is absolutely small, and the formability and processability do not have particular problems.

TABLE 2

Data and evaluation results of Ni-based alloy softened bodies of Examples 1 to 8 and Comparative examples 1 to 8.

| | γ' phase solvus temperature (° C.) | γ' phase equilibrium precipitation at 700° C. (vol. %) | Slow-cooling start temperature based on γ' phase solvus temperature (° C.) | Cooling rate during slow-cooling process (° C./h) | Average γ phase grain diameter (μm) | Grain-boundary γ' phase precipitation in softened body (vol. %) | Room-temperature Vickers hardness of softened body (Hv) | Hot working properties | Cold working properties |
|---|---|---|---|---|---|---|---|---|---|
| Example 1 | 1172 | 50 | +10 | 100 | 20 | 32 | 326 | Passed | Passed |
| Example 2 | 1197 | 73 | +10 | 100 | 19 | 36 | 339 | Passed | Passed |
| Example 3 | 1161 | 47 | +20 | 50 | 12 | 33 | 322 | Passed | Passed |
| Example 4 | 1194 | 57 | +5 | 50 | 15 | 39 | 325 | Passed | Passed |
| Example 5 | 1102 | 38 | +20 | 50 | 9 | 30 | 320 | Passed | Passed |
| Example 6 | 1160 | 56 | +10 | 10 | 15 | 34 | 302 | Passed | Passed |
| Example 7 | 1144 | 52 | +20 | 10 | 8 | 35 | 312 | Passed | Passed |
| Example 8 | 1113 | 40 | +20 | 10 | 13 | 30 | 306 | Passed | Passed |
| Comparative example 1 | 1187 | 50 | +10 | 300 | 14 | 3 | 388 | Failed | Failed |
| Comparative example 2 | 1143 | 53 | +20 | 200 | 10 | 6 | 379 | Failed | Failed |
| Comparative example 3 | 1101 | 39 | −190 | 10 | 11 | 10 | 405 | Failed | Failed |
| Comparative example 4 | 1110 | 40 | −150 | 10 | 13 | 9 | 398 | Failed | Failed |
| Comparative example 5 | 1010 | 24 | +10 | 100 | 19 | 2 | 285 | Passed | Passed |
| Comparative example 6 | 924 | 15 | +10 | 10 | 14 | 0 | 251 | Passed | Passed |
| Comparative example 7 | 1162 | 49 | +10 | 100 | 110 | 0 | 385 | Failed | Failed |
| Comparative example 8 | 1184 | 50 | +20 | 10 | 206 | 0 | 379 | Failed | Failed |

As shown in Table 2, in the softened bodies according to Comparative examples 1 and 2 in which the cooling rate during the slow-cooling process of the softening heat treatment is outside of the invention, the precipitation amount of the grain-boundary γ' phase is less than 20 volume % (instead, coarsened intra-granular γ' phase particles were detected), and the room-temperature Vickers hardness is more than 370 Hv. As a result, both the hot working properties and the cold working properties are failed. When the cooling rate during the slow-cooling process is too high, the grain-boundary γ' phase rarely precipitates and grows.

In the softened bodies according to Comparative examples 7 and 8 in which the average grain diameter of the γ phase is outside of the invention, in the same manner as Comparative examples 1 and 2, the precipitation amount of the grain-boundary γ' phase is less than 20 volume % (instead, coarsened intra-granular γ' phase particles were detected), and the room-temperature Vickers hardness is more than 370 Hv. As a result, both the hot working properties and the cold working properties are failed. If the oxygen content in the precursor body is insufficient, when heated to a temperature equal to or more than the γ' phase solvus temperature, the γ phase grains become significantly coarsened. In the coarsened γ phase grains, grain boundary free energy decreases, and precipitation of the intra-granular γ' phase takes priority over the grain-boundary γ' phase. Therefore, it is confirmed that sufficient formability and processability cannot be ensured.

Contrary to Comparative examples 1 to 8, in the softened bodies according to Examples 1 to 8, any material under test have the precipitation amount of the grain-boundary γ' phase of 20 volume % or more and the room-temperature Vickers hardness of 370 Hv or less. As a result, both the hot working properties and the cold working properties are passed. This means that the effectiveness of the invention is verified.

Experimental 5

(Fabrication and Evaluation of Ni-Based Alloy Members According to Examples 1 to 8 and Comparative Examples 5 and 6)

The shaped workpieces according to Examples 1 to 8 and Comparative examples 5 and 6, whose formability and processability are acceptable, were subjected to the solution and aging heat treatment process, thereby fabricating the Ni-based alloy members. The solution heat treatment was conducted at a temperature 20° C. higher than the γ' phase solvus temperature, and the aging heat treatment was conducted at a temperature of 700° C. Because shaped workpieces were not fabricated in Comparative examples 1-4 and 7-8 wherein the formability/processability is rejected, those samples were excluded from this experiment.

The obtained Ni-based alloy members according to Examples 1 to 8 and Comparative examples 5 and 6 were subjected to the high-temperature tensile test at 700° C. The member with a tensile strength of at least 1000 MPa is judged to be "Passed" and the member with a tensile strength of less than 1000 MPa is judged to be "Failed". As a result, all of the Ni-based alloy members according to Examples 1 to 8 are passed, but the Ni-based alloy members according to Comparative examples 5 and 6 are failed.

Based on the above results, by applying the method for manufacturing an Ni-based alloy member according to the invention, even by using a high precipitation-strengthened Ni-based alloy material or a superhigh precipitation-strengthened Ni-based alloy material, it is possible to provide a softened body having excellent formability and processability, that makes it possible to provide an Ni-based alloy member at low cost.

The above-described embodiments and Examples have been specifically given in order to help with understanding on the present invention, but the invention is not limited to the described embodiments and Examples. For example, a part of an embodiment may be replaced by known art, or added with known art. That is, a part of an embodiment of the invention may be combined with known art and modified based on known art, as far as no departing from a technical concept of the invention.

What is claimed is:

1. A method for manufacturing an Ni-based alloy member, the Ni-based alloy member having a chemical composition comprising:

5 mass % to 25 mass % of Cr, more than 0 mass % to 30 mass % of Co, 1 mass % to 8 mass % of Al, 1 mass % to 10 mass % of Ti, Nb and Ta in total, 10 mass % or less of Fe, 10 mass % or less of Mo, 8 mass % or less of W, 0.1 mass % or less of Zr, 0.1 mass % or less of B, 0.2 mass % or less of C, 2 mass % or less of Hf, 5 mass % or less of Re, 0.003 mass % to 0.05 mass % of O, and the balance being Ni and unavoidable impurities, in which an equilibrium amount of precipitation of a γ' phase precipitating in a γ phase made up of γ phase grains as a matrix at 700° C. is 30 volume % or more and 80 volume % or less, the manufacturing method consisting of:

an alloy powder preparation step of preparing an Ni-based alloy powder having the chemical composition;

a precursor body formation step of forming a precursor body in which an average grain diameter of the γ phase grains is 50 μm or less, by using the Ni-based alloy powder;

a softening heat treatment step of heating the precursor body to a heating temperature equal to or higher than a solvus temperature of the γ' phase but lower than a melting temperature of the γ phase in order to dissolve the γ' phase into the γ phase, and then slow-cooling the heated precursor body from the heating temperature to a temperature at least 50° C. lower than the γ' phase solvus temperature at a cooling rate of 100° C./h or lower, thereby fabricating a softened body in that precipitated particles of the γ' phase on grain boundaries of the γ phase grains make up at least 20 volume %, and the γ phase grains have an average grain diameter of 50 μm or less;

a forming step of forming a shaped workpiece with a desired shape by subjecting the softened body to hot working, warm working, cold working, or machining; and a solution and aging heat treatment step of subjecting the shaped workpiece to a solution heat treatment to thereby decrease the precipitation amount of the γ' phase on the grain boundaries of the γ phase grains to at most 10 volume %, and of subjecting subsequently the shaped workpiece to an aging heat treatment to thereby precipitate particles of the γ' phase of at least 30 volume % within the γ phase grains.

2. The manufacturing method according to claim 1, wherein the Ni-based alloy powder has an average particle diameter from 5 μm to 250 μm.

3. The manufacturing method according to claim 1, wherein the alloy powder preparation step is an atomization step of forming the Ni-based alloy powder.

4. The manufacturing method according to claim 1, wherein the precursor body formation step is a hot isostatic press process using the Ni-based alloy powder.

5. The manufacturing method according to claim 1, wherein the γ' phase solvus temperature is 1110° C. or higher.

6. The manufacturing method according to claim 1, wherein the softened body has a Vickers hardness of 370 Hv or less at a room temperature.

7. The manufacturing method according to claim 1, wherein the cooling rate in the softening heat treatment step is 10° C./h or lower.

8. The manufacturing method according to claim 1, wherein the cooling rate in the softening heat treatment step is 50° C./h or lower.

9. The manufacturing method according to claim 3, wherein the alloy powder preparation step is an atomization step of forming the Ni-based alloy powder.

10. The manufacturing method according to claim 5, wherein the Ni-based alloy member has the chemical composition in which the equilibrium amount of precipitation of the γ' phase at 700° C. is 45 volume % or more and 80 volume % or less.

11. The manufacturing method according to claim 10, wherein the precursor body formation step is a hot isostatic press process using the Ni-based alloy powder.

12. The manufacturing method according to claim 9, wherein the γ' phase solvus temperature is 1110° C. or higher.

13. The manufacturing method according to claim 9, wherein the Ni-based alloy member has the chemical composition in which the equilibrium amount of precipitation of the γ' phase at 700° C. is 45 volume % or more and 80 volume % or less.

14. The manufacturing method according to claim 9, wherein the softened body has a Vickers hardness of 370 Hv or less at a room temperature.

* * * * *